US006151993A

United States Patent [19]

Shiao

[11] Patent Number: 6,151,993

[45] Date of Patent: Nov. 28, 2000

[54] RATCHET SPANNER

[76] Inventor: Hsuan-Sen Shiao, No. 15-1, Lane 369, Min-Chuan Rd., Taichung City, Taiwan

[21] Appl. No.: 09/540,009

[22] Filed: Mar. 30, 2000

[51] Int. Cl.[7] ..... B25B 13/46

[52] U.S. Cl. ..... 81/60

[58] Field of Search ..... 81/60, 61, 62, 81/63, 63.1, 63.2

[56] References Cited

U.S. PATENT DOCUMENTS

| | | | |
|---|---|---|---|
| 1,769,070 | 7/1930 | Nowosielski | 81/60 |
| 2,521,419 | 9/1950 | Sellers | 81/63.1 |
| 5,392,672 | 2/1995 | Larson et al. | 81/60 |
| 5,794,496 | 8/1998 | Arnold | 81/60 |

*Primary Examiner*—Eileen P. Morgan
*Assistant Examiner*—Joni B. Danganan
*Attorney, Agent, or Firm*—Sheridan Ross P.C.

[57] ABSTRACT

A ratchet spanner includes a spanner body with a head portion confined by a peripheral wall. Top and bottom flanges extend inwardly and radially from top and bottom ends of the wall. The top flange has a curved inner peripheral surface with an open-ended slot. The bottom flange defines a bottom opening, and has a circular inner peripheral surface formed with an inward flange that extends radially and inwardly into the bottom opening. A stepped insert member is inserted into the head portion, and has a curved shoulder between upper and lower portions thereof. The upper portion of the insert member is formed with an open-ended slot. The curved shoulder abuts against the top flange of the head portion for preventing upward removal therefrom. A ratchet wheel is rotatably disposed in the head portion, and has an upper annular groove and a lower circular shoulder abutting against the inward flange of the head portion for preventing downward removal therefrom. A C-shaped ring is disposed in the head portion and engages the annular groove in the ratchet wheel, the open-ended slot in the head portion, and the open-ended slot of the insert member for preventing removal of the ratchet wheel and the insert member from the head portion of the spanner body.

1 Claim, 7 Drawing Sheets

RATCHET SPANNER

BACKGROUND OF THE INVENTION

1. Field of the Invention

The present invention relates to a ratchet spanner, more particularly to a ratchet spanner which includes components that can be easily assembled during the manufacturing process thereof and which requires little operating space to operate the same.

2. Description of the Related Art

Referring to FIGS. 1 and 2, a conventional ratchet spanner is shown to include a spanner body 1 and a ratchet mechanism. The spanner body 1 has an annular head portion 101 defining a ratchet accommodating chamber 102 with a lower end opening. The ratchet mechanism includes a ratchet wheel 105 disposed rotatably in a front section 103 of the chamber 102 via the lower end opening such that a tool mounting shank 105" of the ratchet wheel 105 projects outwardly of the chamber 102. Two spring-biased pawls 107 and a pawl actuator 106 are disposed in a rear section 104 of the chamber 102 and are operably connected to the ratchet wheel 105. The pawl actuator 106 can be manually operated in either one of two directions in order to engage a selected one of the pawls 107 with the ratchet wheel 105 such that the conventional ratchet spanner is turnable in only a single direction when in operation.

Some of the drawbacks of the aforementioned conventional ratchet spanner are as follows:

It is somewhat difficult to assemble the components of the aforesaid ratchet spanner. During assembly, after the ratchet wheel 105, the spring-biased pawls 107 and the pawl actuator 106 are mounted in the chamber 102, a cover shield 109 is mounted on the spanner body 1 by the use of screws 109' to prevent downward removal of the ratchet wheel 105 from the head portion 101 of the spanner body 1. As such, a relatively long assembly time is incurred.

In addition, because the ratchet wheel 105 has a relatively small number of teeth 105' with great pitches, in order to ensure engagement between a rectangular end 107' of the pawls 107 and the teeth 105' of the ratchet wheel 105, a large amount of operating space is needed for turning of the spanner body 1.

Referring to FIGS. 3 and 4, another conventional ratchet spanner is shown to include a spanner body 2 and a ratchet mechanism. The spanner body 2 includes an annular head portion 201 which has a peripheral wall 201A with top and bottom ends and an opening 202 formed through the top and bottom ends, and top and bottom flanges that extend radially and inwardly from the top and bottom ends. The ratchet mechanism includes a ratchet wheel 205 that is disposed rotatably within the opening 202 in the head portion 201 and that defines a tool accommodating cavity at the central portion thereof, a pawl unit 206 disposed within the opening 202, and a spring unit 207 that is disposed within a retention bore 204 formed in the peripheral wall 201A and that biases the pawl unit 206 to engage teeth 205' of the ratchet wheel 205.

Because the ratchet wheel 205 is provided with densely located fine profile teeth 205', only a small amount of operating space is required to operate the aforesaid conventional spanner. However, during the manufacture of the pawl unit 206, high precision and great skill are needed to produce such type of fine profile teeth 205. A high manufacturing cost is thus incurred.

During mass production, a curved recess 203 is firstly formed in the peripheral wall 201A. The retention bore 204 is then formed by a milling unit and a drilling unit. Since only a small-diameter cutting tool can be used in order to form the curved recess 203 with a relative depth, the cutting tool easily breaks during high speeds of rotation, thereby inconveniencing the operator.

SUMMARY OF THE INVENTION

Therefore, the object of this invention is to provide a ratchet spanner which includes components that are easily manufactured and assembled during the manufacturing process and which requires a relatively small amount of space to operate the same.

Accordingly, a ratchet spanner of the present invention includes a spanner body, a stepped insert member, and a vertical cylindrical ratchet wheel. The spanner body has a head portion and a handle, which has an end connected fixedly to the head portion. The head portion has a peripheral wall with a top end and a bottom end, a top flange extending integrally and inwardly from the top end of the peripheral wall, and a bottom flange extending integrally and inwardly from the bottom end of the peripheral wall. The top flange defines a top opening therein, and has a curved and slotted inner peripheral surface with an open-ended slot that extends circumferentially therealong. The bottom flange has a circular inner peripheral surface, which is formed with an inward flange that extends integrally, radially and inwardly from a bottom end of the circular inner peripheral surface and that defines a bottom opening therein. The insert member is inserted into the head portion of the spanner body and between the top and bottom flanges. The insert member has a lower portion with a top surface, an upper portion that extends integrally and upwardly from the top surface of the lower portion, and a curved shoulder defined between the upper and lower portions. The upper portion has a curved side surface, which is formed with an open-ended slot that extends circumferentially therealong and that cooperates with the open-ended slot in the head portion of the spanner body to form an annular slot unit. The upper portion extends into the top opening in the head portion of the spanner body. The curved shoulder of the insert member abuts against the top flange of the head portion of the spanner body for preventing upward removal of the insert member from the head portion of the spanner body. The lower portion has a side surface that is formed with a plurality of pawl accommodating chambers and that abuts against the bottom flange for preventing downward removal of the insert member from the head portion of the spanner body. The ratchet wheel is disposed rotatably within the head portion of the spanner body, and has a diameter-reduced bottom end that extends into the bottom opening in the head portion of the spanner body and that defines a circular shoulder, a toothed portion with a plurality of ratchet teeth, and a top end portion that is formed with an annular groove. The circular shoulder of the ratchet wheel abuts against the inward flange of the head portion of the spanner body for preventing downward removal of the ratchet wheel from the head portion of the spanner body. A C-shaped retaining ring engages the annular groove in the ratchet wheel, the open-ended slot in the head portion of the spanner body and the open-ended slot in the insert member for preventing removal of the ratchet wheel and the insert member from the head portion of the spanner body. A plurality of spring-biased pawl elements are received respectively within the chambers in the insert member. Each of the pawl elements has a stop tooth that is biased to engage the teeth of the ratchet wheel for preventing rotation of the ratchet wheel within the head portion of the spanner body in a predetermined direction.

Because the number of the teeth of the ratchet wheel is relatively large, only a relatively small amount of space is required to operate the ratchet spanner of the present invention.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
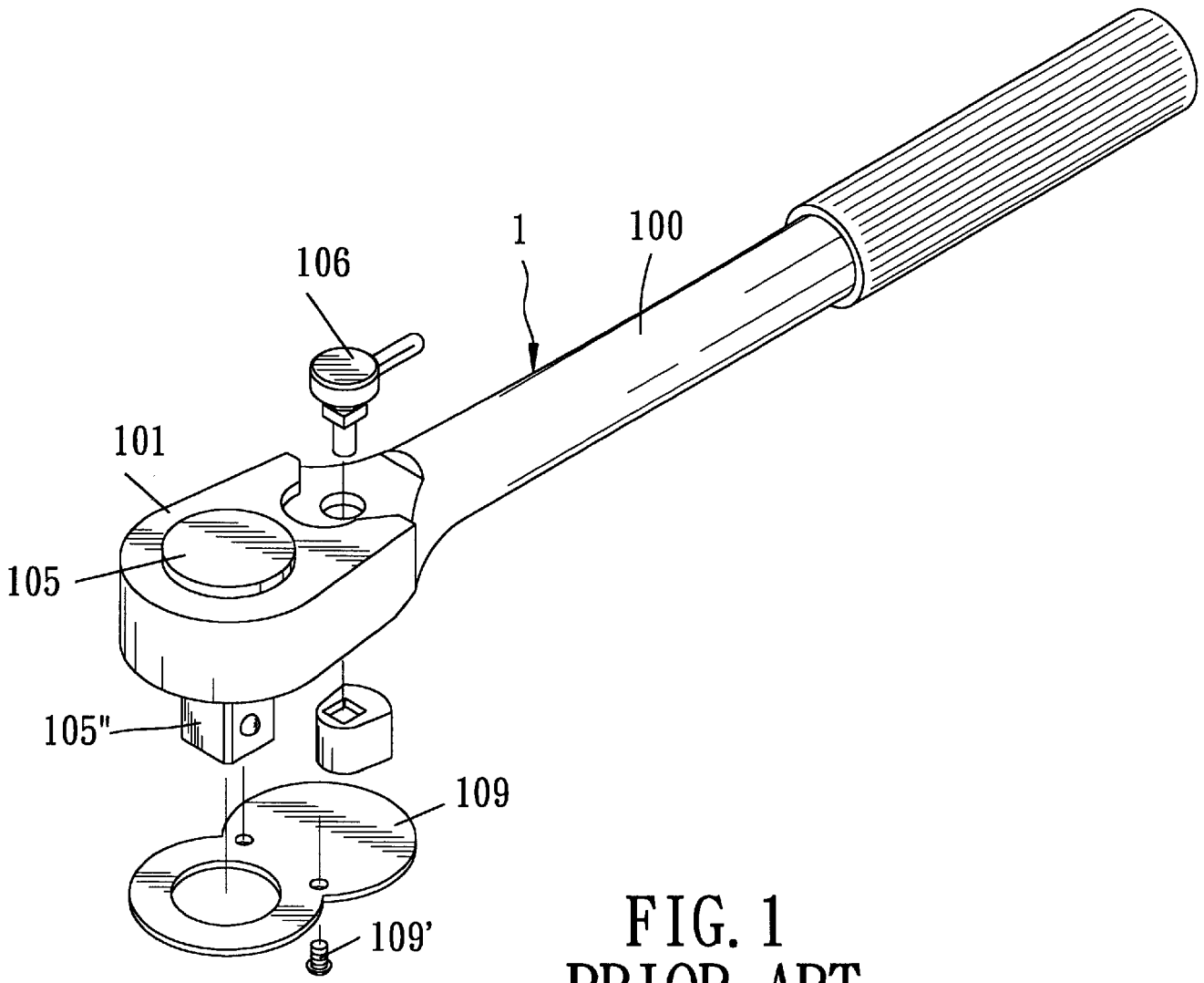
FIG. 1 PRIOR ART
FIG. 1 is a partly exploded perspective view of a conventional ratchet spanner.
Figure 2:
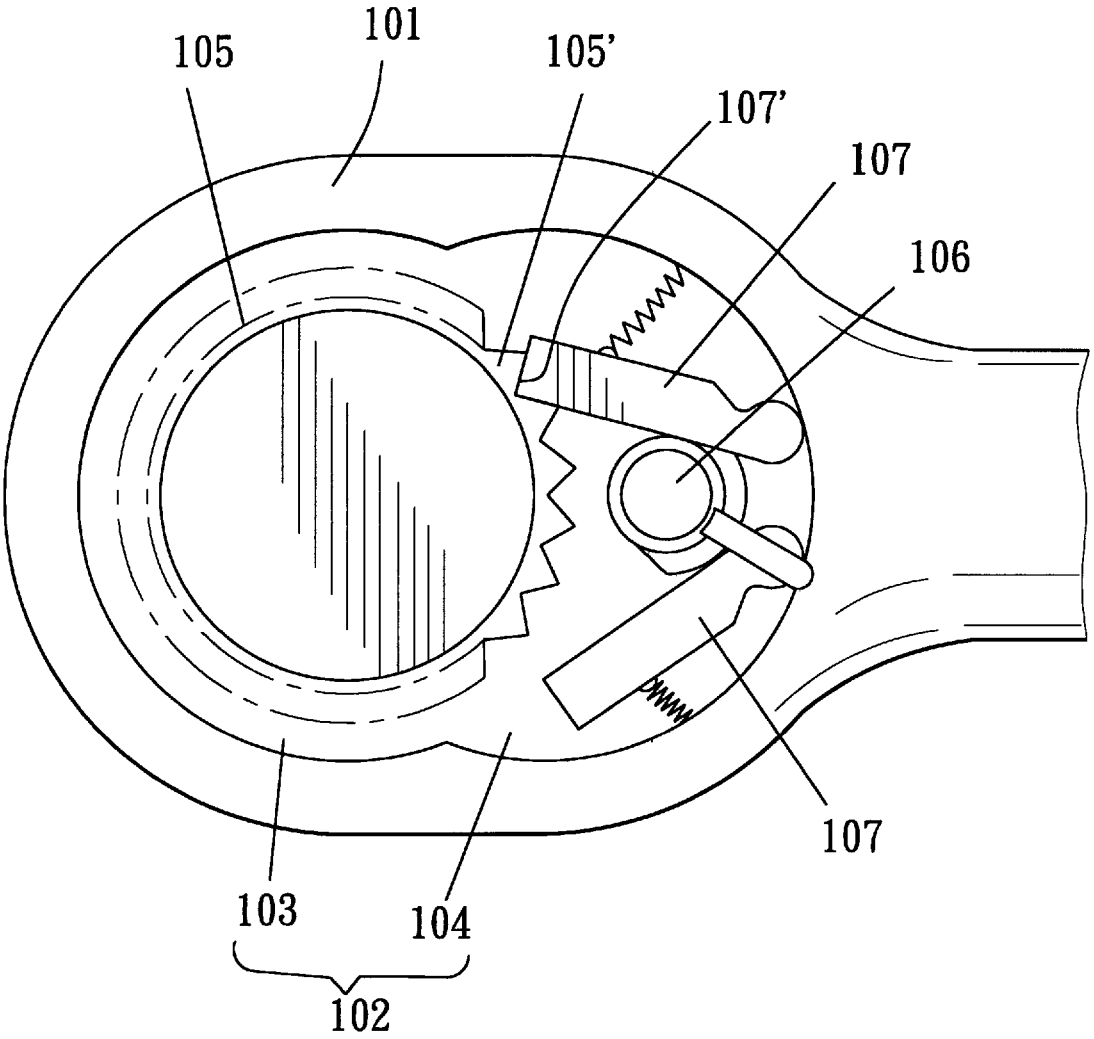
FIG. 2 PRIOR ART
FIG. 2 is a schematic top view of the conventional ratchet spanner, illustrating how a spring-biased pawl unit engages a ratchet wheel.
Figure 3:
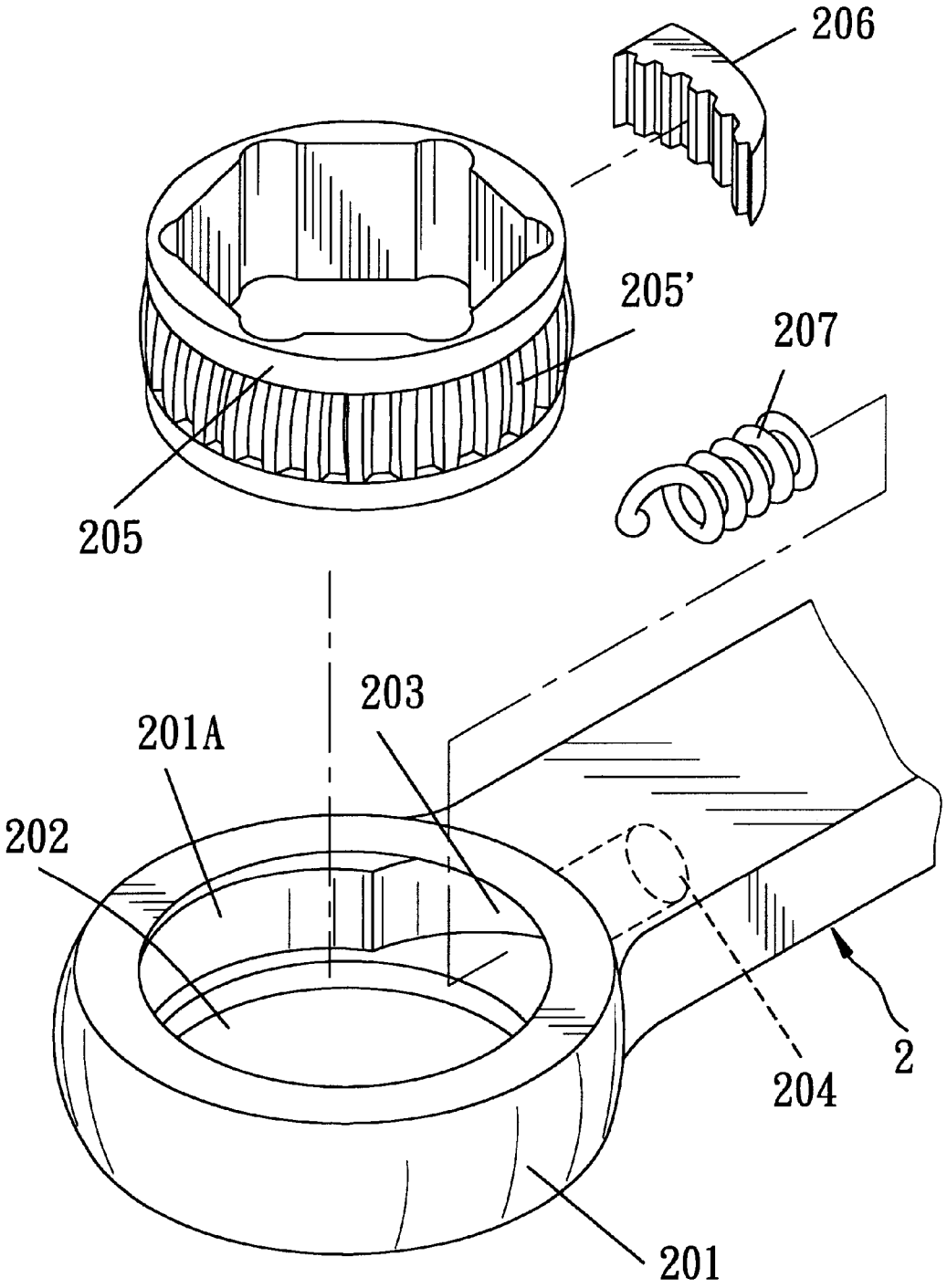
FIG. 3 PRIOR ART
FIG. 3 shows a partly exploded fragmentary perspective view of another conventional ratchet spanner.
Figure 4:
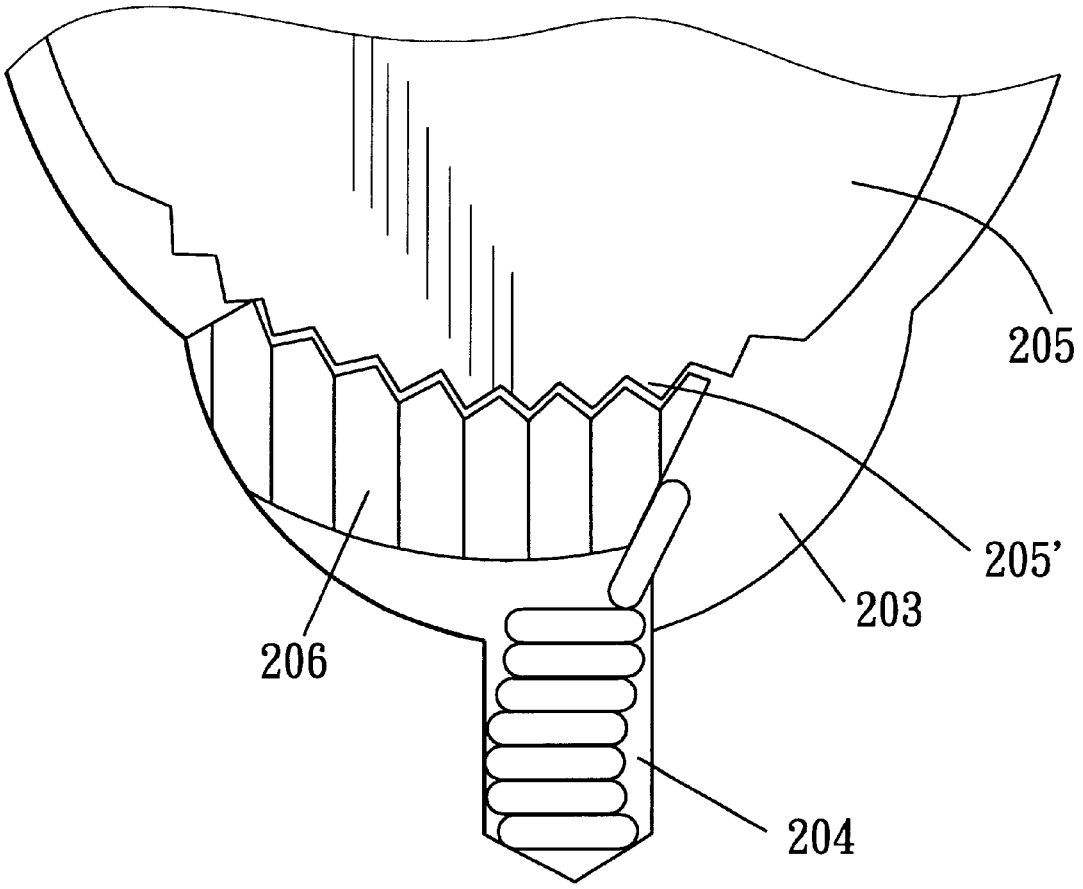
FIG. 4 PRIOR ART
FIG. 4 is a fragmentary schematic view of the conventional ratchet spanner shown in FIG. 3, illustrating how a spring-biased pawl unit engages a ratchet wheel.
Figure 5:
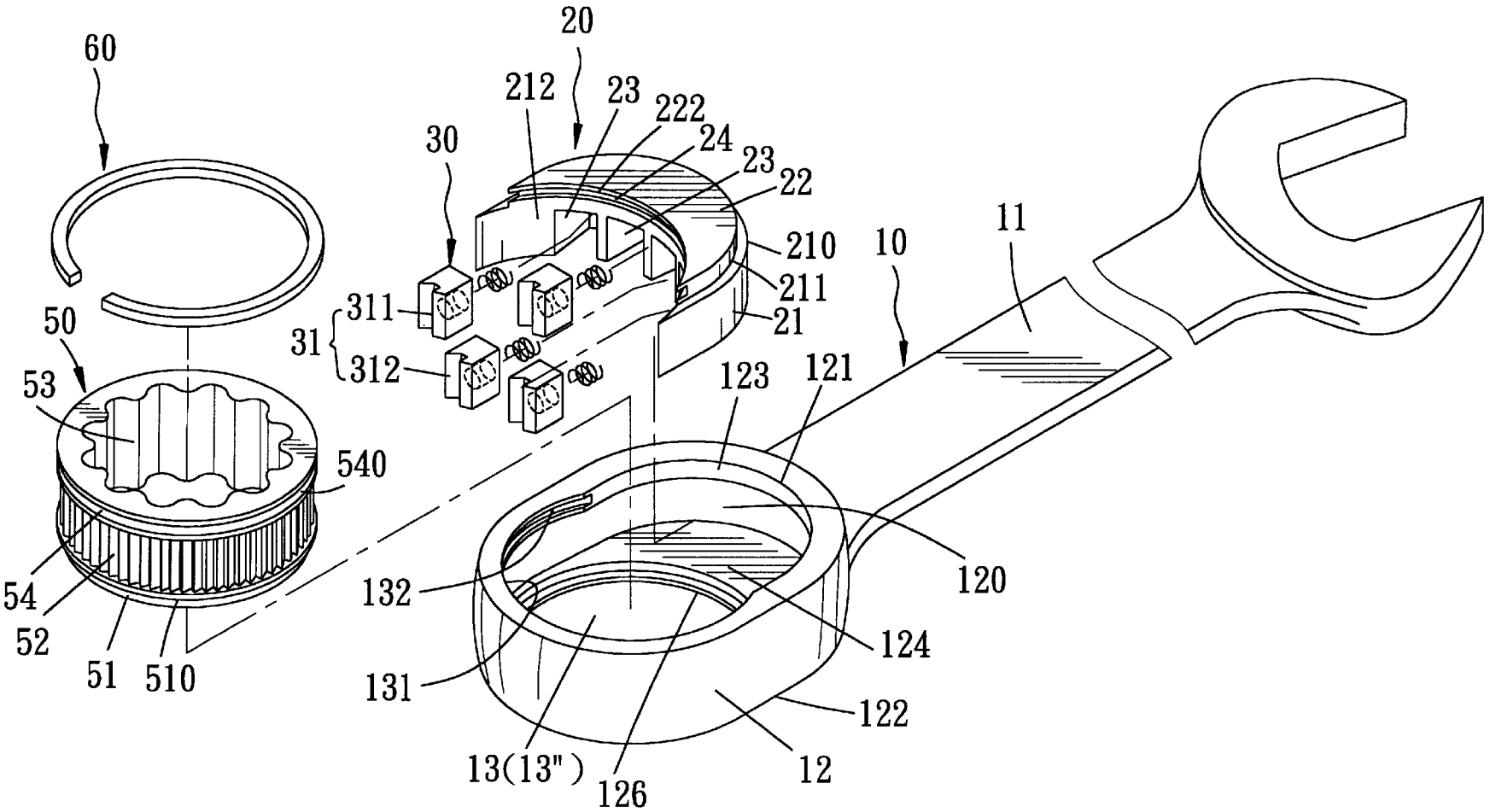
FIG. 5 is an exploded perspective view of the preferred embodiment of a ratchet spanner of the present invention.
Figure 6:
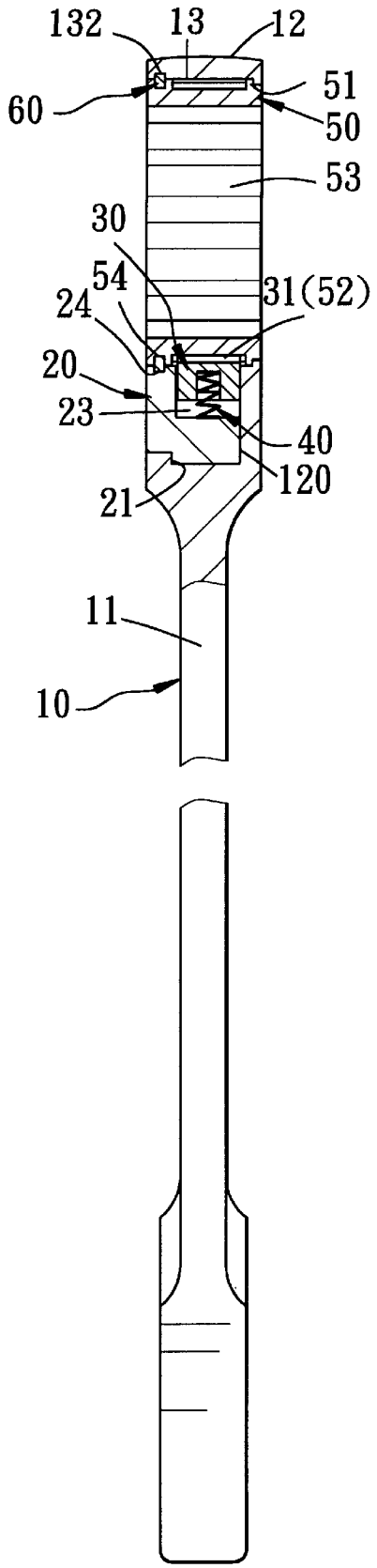
FIG. 6 is a partly sectional schematic side view of the preferred embodiment.
Figure 7:
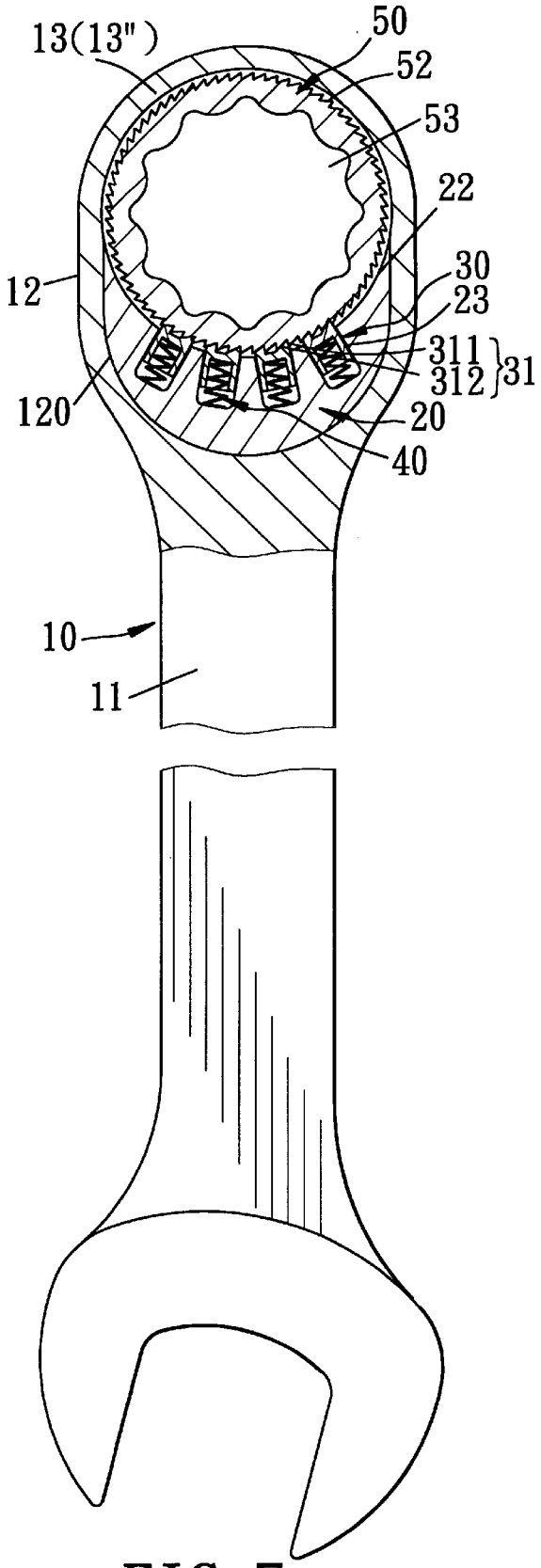
FIG. 7 is a partly sectional schematic top view of the present invention, illustrating how a plurality of spring-biased pawl units are disposed in an end portion of a spanner body.

Referring to FIGS. 5, 6 and 7, the preferred embodiment of a ratchet spanner of the present invention is shown to include a spanner body 10, a stepped insert member 20, a vertical cylindrical ratchet wheel 50, and a C-shaped retaining ring 60.

As illustrated, the spanner body 10 has a head portion 12 and a handle 11, which has an end connected fixedly to the head portion 12. The head portion 12 has a peripheral wall 120 with a top end 121 and a bottom end 122, a top flange 123 that extends integrally and inwardly from the top end 121 of the peripheral wall 120, and a bottom flange 124 that extends integrally and inwardly from the bottom end 122 of the peripheral wall 120. The top flange 123 defines a top opening 13 therein, and has a curved and slotted inner peripheral surface 131 with an open-ended slot 132 that extends circumferentially therealong. The bottom flange 124 has a circular inner peripheral surface, which is formed with an inward flange 126 that extends integrally, radially and inwardly from a bottom end of the circular inner peripheral surface and that defines a bottom opening 13" therein.

The stepped insert member 20 is inserted into the head portion 12 of the spanner body 10 and between the top and bottom flanges 123, 124. The insert member 20 has a lower portion 21 with a top surface 210, and an upper portion 22 that extends integrally and upwardly from the top surface 210 of the lower portion 21, and a curved shoulder 211 defined between the upper and lower portions 21,22. The upper portion 22 has an inner curved side surface 222, which is formed with an open-ended slot 24 that extends circumferentially therealong and that cooperates with the open-ended slot 132 in the head portion 12 of the spanner body 10 to form an annular slot unit. The upper portion 22 extends into the top opening 13 in the head portion 12 of the spanner body 10. Under such a condition, the curved shoulder 211 of the insert member 20 abuts against the top flange 123 of the head portion 12 in the spanner body 10 for preventing upward removal of the insert member 20 from the head portion 12 of the spanner body 10. The lower portion 21 further has a side surface 212 which is formed with four pawl accommodating chambers 23 and which abuts against the bottom flange 124 for preventing downward removal of the insert member 22 from the head portion 12 of the spanner body 10.

The cylindrical ratchet wheel 50 is disposed rotatably within the head portion 12 of the spanner body 10, and has a diameter-reduced bottom end 51 that extends into the bottom opening 13" in the head portion 12 of the spanner body 10 and that defines a circular shoulder 510. The ratchet wheel 50 further has a toothed portion 52 with a plurality of ratchet teeth, and a top end portion 54 that is formed with an annular groove 540. The circular shoulder 510 of the ratchet wheel 50 abuts against the inward flange 126 of the head portion 12 of the spanner body 10 for preventing downward removal of the ratchet wheel 50 from the head portion 12 of the spanner body 10. The ratchet wheel 50 further defines a tool accommodating cavity 53 at a central portion thereof.

The retaining ring 60 is pressed inwardly and radially so as to be disposed in the head portion 12 of the spanner body 10 around the ratchet wheel 50 in such a manner that the ring 60 engages the annular groove 540 in the ratchet wheel 50, the open-ended slot 132 in the head portion 12 of the spanner body 10 and the open-ended slot 24 in the insert member 20 for preventing removal of the ratchet wheel 50 and the insert member 20 from the head portion 12 of the spanner body 10.

Four spring-biased pawl elements 30 are received respectively within the chambers 23 in the insert member 20. Each of the pawl elements 30 has a stop tooth 31 that is biased to engage the teeth of the ratchet wheel 50 for permitting rotation of the ratchet wheel 50 within the head portion 12 of the spanner body 10 in a first direction. In the preferred embodiment, the stop tooth 31 is formed with a straight side 311 and an inclined side 312 such that when the handle 11 of the spanner body 10 is rotated in a second direction opposite to the first direction, the ratchet wheel 50 is stopped by the straight sides 311 of the stop teeth 31, thereby preventing rotation of the spanner body 10 in the second direction.

The advantages that result from the use of the aforesaid ratchet spanner of this invention are as follows:

Since the pawl elements 30 are constantly biased by spring units 40 in a radial direction with respect to the ratchet wheel 50, engagement of the pawl elements 30 with the ratchet wheel 50 is ensured. The fine profile teeth on the ratchet wheel 50 further ensure that only little operating space is required when operating the ratchet spanner of the present invention.

The top and bottom flanges 123, 124 in the head portion 12 of the spanner body 10, and the ratchet accommodating bore between the top and bottom flanges 123,124 can be formed by a large-diameter milling tool, which does not break during the machining process.

With this invention thus explained, it is apparent that numerous modifications and variations can be made without departing from the scope and spirit of this invention. It is therefore intended that the invention be limited only as indicated in the appended claims.

What is claimed is:

1. A ratchet spanner comprising:

a spanner body having a head portion and a handle, which has an end connected fixedly to said head portion, said head portion having a peripheral wall with a top end and a bottom end, a top flange extending integrally and inwardly from said top end of said peripheral wall, and a bottom flange extending integrally and inwardly from said bottom end of said peripheral wall, said top flange defining a top opening therein and having a curved and slotted inner peripheral surface with an open-ended slot that extends circumferentially therealong, said bottom flange having a circular inner peripheral surface, which is formed with an inward flange that extends integrally, radially and inwardly from a bottom end of said circular inner peripheral surface and that defines a bottom opening therein;

a stepped insert member inserted into said head portion of said spanner body and between said top and bottom flanges, said insert member having a lower portion with a top surface, an upper portion extending integrally and upwardly from said top surface of said lower portion, and a curved shoulder defined between said upper and lower portions, said upper portion having a curved side surface, which is formed with an open-ended slot that extends circumferentially therealong and that cooperates with said open-ended slot in said head portion of said spanner body to form an annular slot unit, said upper portion extending into said top opening in said head portion of said spanner body, said curved shoulder of said insert member abutting against said top flange of said head portion of said spanner body for preventing upward removal of said insert member from said head portion of said spanner body, said lower portion having a side surface with a plurality of pawl accommodating chambers and abutting against said bottom flange for preventing downward removal of said insert member from said head portion of said spanner body;

a vertical cylindrical ratchet wheel disposed rotatably within said head portion of said spanner body, and having a diameter-reduced bottom end that extends into said bottom opening in said head portion of said spanner body and that defines a circular shoulder, a toothed portion with a plurality of ratchet teeth, and a top end portion that is formed with an annular groove, said circular shoulder of said ratchet wheel abutting against said inward flange of said head portion of said spanner body for preventing downward removal of said ratchet wheel from said head portion of said spanner body;

a C-shaped retaining ring engaging said annular groove in said ratchet wheel, said open-ended slot in said head portion of said spanner body and said open-ended slot in said insert member for preventing removal of said ratchet wheel and said insert member from said head portion of said spanner body; and a plurality of spring-biased pawl elements received respectively within said chambers in said insert member, each of said pawl elements having a stop tooth that is biased to engage said teeth of said ratchet wheel for preventing rotation of said ratchet wheel within said head portion of said spanner body in a predetermined direction.

* * * * *